US009914028B1

(12) United States Patent
Cleghorn et al.

(10) Patent No.: US 9,914,028 B1
(45) Date of Patent: Mar. 13, 2018

(54) GOLF CLUB WITH MOVABLE WEIGHT

(71) Applicant: Acushnet Company, Fairhaven, MA (US)

(72) Inventors: Richard L. Cleghorn, Oceanside, CA (US); Darryl C. Galvan, El Cajon, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 15/257,692

(22) Filed: Sep. 6, 2016

(51) Int. Cl.
*A63B 53/06* (2015.01)
*A63B 53/04* (2015.01)

(52) U.S. Cl.
CPC ..... *A63B 53/0466* (2013.01); *A63B 53/06* (2013.01); *A63B 2053/0433* (2013.01); *A63B 2053/0491* (2013.01); *A63B 2053/0495* (2013.01)

(58) Field of Classification Search
CPC ..... A63B 53/06; A63B 2053/0491; A63B 2053/0433; A63B 2053/0495
USPC ..... 473/334–339, 344, 345
See application file for complete search history.

(56) References Cited

U.S. PATENT DOCUMENTS

| | | | |
|---|---|---|---|
| 80,435 | A | 7/1868 | Way |
| 996,937 | A | 7/1911 | Mulock |
| 1,133,129 | A | 3/1915 | Govan |
| 1,167,106 | A | 1/1916 | Palmer |
| 1,320,163 | A | 10/1919 | Murice Fitz |
| 1,322,182 | A | 11/1919 | Duncan |
| 1,534,600 | A | 4/1925 | Mattern |
| 2,155,830 | A | 4/1939 | Howard |
| 2,171,383 | A | 8/1939 | Wettlaufer |
| 2,214,356 | A | 9/1940 | Wettlaufer |
| 2,517,245 | A | 8/1950 | Scott |
| 2,545,045 | A | 3/1951 | Rosan |
| 2,592,013 | A | 4/1952 | Curley |
| 2,652,256 | A | 9/1953 | Thomas |
| 3,064,980 | A | 11/1962 | Steiner |
| 3,212,783 | A | 10/1965 | Bradley et al. |
| 3,220,733 | A | 11/1965 | Saleeby |
| 3,259,404 | A | 7/1966 | Papenguth |
| 3,466,047 | A | 9/1969 | Rodia et al. |

(Continued)

FOREIGN PATENT DOCUMENTS

| | | |
|---|---|---|
| GB | 2133295 | 7/1984 |
| JP | H06-238022 | 8/1994 |

(Continued)

*Primary Examiner* — Benjamin Layno
(74) *Attorney, Agent, or Firm* — Kevin N. McCoy

(57) ABSTRACT

A golf club head including an elongate weight receptacle, the weight receptacle including: a first locking rail extending from the exterior surface of the body, the first locking rail running along a first side of the weight receptacle; a second locking rail extending from an exterior surface of the body, the second locking rail running along a second side of the weight receptacle, the first locking rail spaced from the second locking rail; a weight member located in the weight receptacle; wherein the weight member is configured to slide along the weight receptacle when the weight member is in an unlocked position and the weight member is configured to lock in place in the weight receptacle when the weight member is in a locked position; wherein the weight member at least partially resides between the first locking rail and the second locking rail.

20 Claims, 17 Drawing Sheets

(56) References Cited

U.S. PATENT DOCUMENTS 3,556,533 A 1/1971 Hollis
3,604,755 A 9/1971 Krekeler
3,652,094 A 3/1972 Glover
3,692,306 A 9/1972 Glover
3,979,123 A 9/1976 Belmont
4,026,183 A 5/1977 Bart
4,027,881 A 6/1977 Hufenus
4,043,563 A 8/1977 Churchward
4,052,075 A 10/1977 Daly
4,085,934 A 4/1978 Churchward
4,194,547 A 3/1980 Sidor et al.
4,340,230 A 7/1982 Churchward
4,423,874 A 1/1984 Stuff, Jr.
4,443,145 A 4/1984 Peschges
4,450,904 A 5/1984 Volz
4,538,790 A 9/1985 Williams et al.
4,602,787 A 7/1986 Sugioka et al.
4,795,159 A 1/1989 Nagamoto
4,867,458 A 9/1989 Sumikawa et al.
4,869,507 A 9/1989 Sahm
4,895,371 A 1/1990 Bushner
4,958,970 A 9/1990 Rose et al.
5,050,879 A 9/1991 Sun et al.
5,154,424 A 10/1992 Lo
5,168,767 A 12/1992 Morita
5,230,509 A 7/1993 Chavez
5,236,164 A 8/1993 Lorizzo
5,297,794 A 3/1994 Lu
5,316,305 A 5/1994 McCabe
5,320,005 A 6/1994 Hsiao
5,518,243 A 5/1996 Redman
5,547,326 A 8/1996 Overhues
5,571,053 A 11/1996 Lane
5,683,309 A 11/1997 Reimers
5,688,189 A 11/1997 Bland
5,720,674 A 2/1998 Galy
5,769,737 A 6/1998 Holladay
5,795,245 A 8/1998 Chang et al.
5,860,779 A 1/1999 Toosky et al.
5,904,460 A 5/1999 Kawabata
5,916,042 A 6/1999 Reimers
5,935,019 A 8/1999 Yamamoto
5,947,840 A 9/1999 Ryan
5,967,905 A 10/1999 Nakahara et al.
6,015,354 A 1/2000 Ahn
6,017,177 A 1/2000 Lanham
6,056,649 A 5/2000 Imai
6,089,994 A 7/2000 Sun
6,123,627 A 9/2000 Antonious
6,162,132 A 12/2000 Yoneyama
6,217,461 B1 4/2001 Galy
6,277,032 B1 8/2001 Smith
6,296,574 B1 10/2001 Kaldis
6,306,048 B1 10/2001 McCabe et al.
6,348,014 B1 2/2002 Chiu
6,379,264 B1 4/2002 Forzano
6,379,265 B1 4/2002 Hirakawa et al.
6,409,612 B1 6/2002 Evans et al.
6,436,142 B1 8/2002 Paes et al.
6,458,044 B1 10/2002 Vincent et al.
6,648,772 B2 11/2003 Vincent et al.
6,719,510 B2 4/2004 Cobzaru
6,749,523 B1 6/2004 Forzano
6,773,360 B2 8/2004 Willett et al.
6,811,496 B2 11/2004 Wahl et al.
6,860,818 B2 3/2005 Mahaffey et al.
6,881,158 B2 4/2005 Yang et al.
6,988,960 B2 1/2006 Mahaffey et al.
7,121,956 B2 10/2006 Lo
7,147,573 B2 12/2006 DiMarco
7,153,220 B2 12/2006 Lo
7,166,040 B2 1/2007 Hoffman et al.
7,166,041 B2 1/2007 Evans
7,179,034 B2 2/2007 Ladouceur
7,186,190 B1 3/2007 Beach et al.
7,189,169 B2 3/2007 Billings
7,201,669 B2 4/2007 Stites
7,223,180 B2 5/2007 Willett et al.
7,294,065 B2 11/2007 Liang et al.
7,326,472 B2 2/2008 Shimazaki et al.
7,351,161 B2 4/2008 Beach
7,404,772 B2 7/2008 Koide
7,407,447 B2 8/2008 Beach
7,410,425 B2 8/2008 Willett et al.
7,410,426 B2 8/2008 Willett et al.
7,419,441 B2 9/2008 Hoffman et al.
7,448,963 B2 11/2008 Beach et al.
7,452,285 B2 11/2008 Chao et al.
7,452,286 B2 11/2008 Lin
7,520,820 B2 4/2009 Dimarco
7,530,901 B2 5/2009 Imamoto
7,530,904 B2 5/2009 Beach et al.
7,540,811 B2 6/2009 Beach et al.
7,568,985 B2 8/2009 Beach et al.
7,578,753 B2 8/2009 Beach et al.
7,591,738 B2 9/2009 Beach
7,604,548 B2 10/2009 Cole
7,611,424 B2 11/2009 Nagai
7,621,823 B2 11/2009 Beach
7,628,707 B2 12/2009 Beach
7,628,711 B2 12/2009 Akinori et al.
7,632,194 B2 12/2009 Beach et al.
7,670,235 B2 3/2010 Lo
7,704,163 B2 4/2010 Stites
7,713,142 B2 5/2010 Hoffman et al.
7,717,803 B2 5/2010 DiMarco
7,717,804 B2 5/2010 Beach et al.
7,717,805 B2 5/2010 Beach et al.
D617,858 S 6/2010 Llewellyn
7,744,484 B1 6/2010 Chao et al.
7,758,452 B2 7/2010 Soracco
7,771,290 B2 8/2010 Bezilla et al.
7,775,905 B2 8/2010 Beach
7,806,781 B2 10/2010 Imamoto
7,806,782 B2 10/2010 Stites
7,846,041 B2 12/2010 Beach
7,927,231 B2 4/2011 Sato
7,963,861 B2 6/2011 Beach
8,016,694 B2 9/2011 Llewellyn
8,043,167 B2 10/2011 Boyd et al.
8,066,584 B2 11/2011 Stites
8,092,316 B2 1/2012 Breier et al.
8,105,175 B2 1/2012 Breier et al.
8,182,363 B2 5/2012 Bezilla et al.
8,192,302 B2 6/2012 Knutson et al.
8,192,303 B2 6/2012 Ban
8,202,175 B2 6/2012 Ban
8,206,243 B2 6/2012 Stites
8,292,757 B2 10/2012 Soracco
8,298,096 B2 10/2012 Stites
8,308,583 B2 11/2012 Morris
8,388,465 B2 3/2013 De La Cruz et al.
8,435,135 B2 5/2013 Stites et al.
8,435,136 B2 5/2013 Stites
8,444,505 B2 5/2013 Beach
8,540,589 B2 9/2013 Bezilla et al.
8,562,457 B2 10/2013 Beach
8,684,863 B2 4/2014 Bezilla et al.
8,690,706 B2 4/2014 Stites
8,696,491 B1 4/2014 Myers
8,734,271 B2 5/2014 Beach
D709,571 S 7/2014 Sargent
D709,572 S 7/2014 Sargent
8,790,195 B1 7/2014 Myers
8,834,294 B1 9/2014 Seluga
8,870,678 B2 10/2014 Beach
8,888,607 B2 11/2014 Harbert
8,894,506 B1 11/2014 Myers
8,900,069 B2 12/2014 Beach
8,968,116 B1 3/2015 Myers
9,084,921 B1 7/2015 Liang
9,174,096 B2 11/2015 Sargent
9,180,349 B1 * 11/2015 Seluga ..... A63B 53/04
9,186,560 B2 11/2015 Harbert

(56) References Cited

U.S. PATENT DOCUMENTS

| | | | | |
|---|---|---|---|---|
| 9,199,145 | B1 | 12/2015 | Myers | |
| 9,211,447 | B2 | 12/2015 | Harbert | |
| 9,211,453 | B1 | 12/2015 | Foster | |
| 9,220,953 | B2 | 12/2015 | Beach | |
| 9,220,957 | B1 | 12/2015 | Myers | |
| 9,238,162 | B2 | 1/2016 | Breier | |
| 9,259,625 | B2 | 2/2016 | Sargent | |
| 9,259,627 | B1 | 2/2016 | Myers | |
| 9,278,262 | B2 | 3/2016 | Sargent | |
| 9,289,660 | B1 | 3/2016 | Myers | |
| 9,308,423 | B1 | 4/2016 | Tang | |
| 9,364,728 | B1 | 6/2016 | Myers | |
| 9,364,729 | B2 | 6/2016 | Myers | |
| 9,375,618 | B2 | 6/2016 | Myers | |
| 9,387,376 | B1 | 7/2016 | Hall | |
| 9,387,377 | B2 | 7/2016 | Liang | |
| 9,623,294 | B1 * | 4/2017 | Kingston | A63B 53/0466 |
| 9,682,298 | B1 * | 6/2017 | Kingston | A63B 53/06 |
| 2003/0148818 | A1 | 8/2003 | Myrhum et al. | |
| 2006/0058112 | A1 | 3/2006 | Haralason et al. | |
| 2006/0100029 | A1 | 5/2006 | Lo | |
| 2006/0122004 | A1 | 6/2006 | Chen | |
| 2006/0217216 | A1 | 9/2006 | Iizuka | |
| 2006/0240908 | A1 | 10/2006 | Adams | |
| 2007/0135231 | A1 | 6/2007 | Lo | |
| 2007/0155534 | A1 | 7/2007 | Tsai et al. | |
| 2007/0178988 | A1 | 8/2007 | Tavares | |
| 2008/0020861 | A1 | 1/2008 | Adams | |
| 2008/0039229 | A1 | 2/2008 | Lo | |
| 2008/0132353 | A1 | 6/2008 | Hsiao | |
| 2008/0261715 | A1 | 10/2008 | Carter | |
| 2010/0075773 | A1 | 3/2010 | Casati | |
| 2014/0113741 | A1 | 4/2014 | Bezilla | |
| 2015/0038258 | A1 | 2/2015 | Beach | |
| 2015/0306474 | A1 | 10/2015 | Breier | |
| 2015/0306475 | A1 | 10/2015 | Curtis | |
| 2015/0321055 | A1 * | 11/2015 | Golden | A63B 53/0466 473/338 |
| 2016/0001146 | A1 | 1/2016 | Sargent | |
| 2016/0008687 | A1 | 1/2016 | Sargent | |
| 2016/0023060 | A1 | 1/2016 | Harbert | |
| 2016/0051869 | A1 | 2/2016 | Foster | |
| 2016/0059093 | A1 | 3/2016 | Nielson | |
| 2016/0059094 | A1 | 3/2016 | Mata | |
| 2016/0089583 | A1 | 3/2016 | Breier | |
| 2016/0129323 | A1 | 5/2016 | Myers | |
| 2016/0136490 | A1 | 5/2016 | Sargent | |
| 2016/0175668 | A1 | 6/2016 | Tang | |
| 2016/0375326 | A1 * | 12/2016 | Nunez | A63B 60/52 473/335 |

FOREIGN PATENT DOCUMENTS

| | | |
|---|---|---|
| JP | 10-137374 | 5/1998 |
| JP | 10-234902 | 9/1998 |
| JP | 10-248964 | 9/1998 |
| JP | 11-319167 | 11/1999 |
| JP | 2000-005350 | 1/2000 |
| JP | 2000-176059 | 6/2000 |
| JP | 2001-000606 | 1/2001 |
| JP | 2001-149514 | 6/2001 |
| JP | 2002-011124 | 1/2002 |
| JP | 3109501 | 3/2005 |
| JP | 2005-160947 | 6/2005 |
| JP | 2005-296582 | 10/2005 |
| JP | 2005-323978 | 11/2005 |
| JP | 2006-000435 | 1/2006 |
| JP | 2006-081862 | 3/2006 |
| JP | 2006-122334 | 5/2006 |
| JP | 2006-187489 | 7/2006 |
| JP | 2006-198251 | 8/2006 |
| JP | 2006-239154 | 9/2006 |
| JP | 2006-320493 | 11/2006 |
| JP | 2007-313304 | 12/2007 |
| JP | 2011-229914 | 11/2011 |
| WO | WO 2009/102661 | 8/2009 |

* cited by examiner

GOLF CLUB WITH MOVABLE WEIGHT

TECHNICAL FIELD

This present technology generally relates to systems, devices, and methods related to golf clubs, and more specifically to golf club heads having movable weights.

DESCRIPTION OF THE RELATED TECHNOLOGY

The trend of lengthening golf courses to increase their difficulty has resulted in a high percentage of amateur golfers constantly searching for ways to achieve more distance from their golf shots. The golf industry has responded by providing golf clubs specifically designed with distance and accuracy in mind. The size of wood-type golf club heads has generally been increased while multi-material construction and reduced wall thicknesses have been included to provide more mass available for selective placement through the head. The discretionary mass placement has allowed the club to possess a higher moment of inertia (MOI), which translates to a greater ability to resist twisting during off-center ball impacts and less of a distance penalty for those off-center ball impacts. Additionally, discretionary mass placement has allowed the club to more optimally locate the center of gravity (CG) of the golf club head, and sometimes make that CG location adjustable through the use of adjustable and/or movable weights.

Though many methods of optimizing the mass properties of golf club heads exist, there remains a need in the art for a golf club head comprising at least one easily and quickly movable weight having a secure attachment. The present invention is directed to an improved weighting system for golf clubs that increases the club's playability.

SUMMARY

The systems, methods, and devices described herein have innovative aspects, no single one of which is indispensable or solely responsible for their desirable attributes. Without limiting the scope of the claims, some of the advantageous features will now be summarized.

Though many methods of optimizing the mass properties of golf club heads exist, there remains a need in the art for a golf club head comprising at least one easily and quickly movable weight having a secure attachment. The present invention is directed to an improved weighting system for golf clubs that increases the club's playability.

One non-limiting embodiment of the present technology includes a golf club head, including: a body having a face, a sole, a crown, and a skirt joining the face, sole and crown; a hollow golf club interior within the body; the body having an exterior surface opposite the hollow golf club interior; the body having a coordinate system with an x-axis located horizontal to the club face, a y-axis located vertical to the club face, and a z-axis located through the club face; the body having a center of gravity; wherein the body comprises an elongate weight receptacle, the weight receptacle including: a first locking rail extending from the exterior surface of the body, the first locking rail running along a first side of the weight receptacle; a second locking rail extending from an exterior surface of the body, the second locking rail running along a second side of the weight receptacle, the first locking rail spaced from the second locking rail; wherein the first locking rail comprises a first rail angle, the first rail angle measured between a first rail locking surface and the exterior surface of the body, the second locking rail comprises a second rail angle, the second rail angle measured between a second rail locking surface and the exterior of the body, wherein the first rail angle and the second rail angle are between 85 degrees and 15 degrees; a weight member located in the weight receptacle; wherein the weight member is configured to slide along the weight receptacle when the weight member is in an unlocked position and the weight member is configured to lock in place in the weight receptacle when the weight member is in a locked position; wherein the weight member at least partially resides between the first locking rail and the second locking rail; wherein the weight member has a width, and wherein the width of the weight member is greater when the weight member is in an unlocked position than when the weight member is in a locked position; wherein the weight member comprises a first portion and a second portion, wherein the first portion is slideably affixed to the second portion such that the first portion slides towards the second portion when the weight member is locked in place; wherein the weight member comprises a third member; and wherein the width of the weight member decreases as the third member is rotated in a first direction; wherein the weight member forces the first locking rail towards the second locking rail when the weight member is locked in place; wherein the first member comprises a first engagement member, wherein the second member comprises a second engagement member, wherein the first engagement member engages the first locking surface of the first locking rail and the second engagement member engages the second locking surface of the second locking rail when the weight member is in a locked position; wherein the weight receptacle is located on the sole.

An additional non-limiting embodiment of the present technology includes a golf club head, including: a body having a face, a sole, a crown, and a skirt joining the face, sole and crown; a hollow golf club interior within the body; the body having an exterior surface opposite the hollow golf club interior; the body having a coordinate system with an x-axis located horizontal to the club face, a y-axis located vertical to the club face, and a z-axis located through the club face; the body having a center of gravity; wherein the body comprises an elongate weight receptacle, the weight receptacle including: a first locking rail extending from the exterior surface of the body, the first locking rail running along a first side of the weight receptacle; a second locking rail extending from an exterior surface of the body, the second locking rail running along a second side of the weight receptacle, the first locking rail spaced from the second locking rail; a weight member located in the weight receptacle; wherein the weight member is configured to slide along the weight receptacle when the weight member is in an unlocked position and the weight member is configured to lock in place in the weight receptacle when the weight member is in a locked position; wherein the weight member at least partially resides between the first locking rail and the second locking rail; wherein the weight member has a width, and wherein the width of the weight member is greater when the weight member is in an unlocked position than when the weight member is in a locked position.

In an additional non-limiting embodiment of the present technology the weight member comprises a first portion and a second portion, wherein the first portion is slideably affixed to the second portion such that the first portion slides towards the second portion when the weight member is locked in place.

In an additional non-limiting embodiment of the present technology the weight member comprises a third member; and wherein the width of the weight member decreases as the third member is rotated in a first direction.

In an additional non-limiting embodiment of the present technology the first member comprises a first engagement member, wherein the second member comprises a second engagement member, wherein the first engagement member engages the first locking rail and the second engagement member engages the second locking rail when the weight member is in a locked position.

In an additional non-limiting embodiment of the present technology the first member comprises a first engagement member, wherein the second member comprises a second engagement member, wherein the first engagement member engages the first locking surface of the first locking rail and the second engagement member engages the second locking surface of the second locking rail when the weight member is in a locked position.

In an additional non-limiting embodiment of the present technology the weight member forces the first locking rail towards the second locking rail when the weight member is locked in place.

In an additional non-limiting embodiment of the present technology the weight receptacle is located on the sole.

In an additional non-limiting embodiment of the present technology the first locking rail comprises a first rail angle, the first rail angle measured between a first rail locking surface and the exterior surface of the body, the second locking rail comprises a second rail angle, the second rail angle measured between a second rail locking surface and the exterior of the body, wherein the first rail angle and the second rail angle are between 85 degrees and 15 degrees.

In an additional non-limiting embodiment of the present technology the first rail angle and the second rail angle are between 75 degrees and 25 degrees.

In an additional non-limiting embodiment of the present technology the first rail angle and the second rail angle are between 65 degrees and 35 degrees.

An additional non-limiting embodiment of the present technology includes a golf club head, including: a body having a face, a sole, a crown, and a skirt joining the face, sole and crown; a hollow golf club interior within the body; the body having an exterior surface opposite the hollow golf club interior; the body having a coordinate system with an x-axis located horizontal to the club face, a y-axis located vertical to the club face, and a z-axis located through the club face; the body having a center of gravity; wherein the body comprises an elongate weight receptacle, the weight receptacle including: a locking rail extending from the exterior surface of the body, the first locking rail running along a first side of the weight receptacle; a weight member slideably affixed to the locking rail; wherein the weight member is configured to slide along the weight receptacle when the weight member is in an unlocked position and the weight member is configured to lock in place in the weight receptacle when the weight member is in a locked position; wherein the weight member at least partially resides on each side of the locking rail; wherein the weight member has a width, and wherein the width of the weight member is greater when the weight member is in an unlocked position than when the weight member is in a locked position.

In an additional non-limiting embodiment of the present technology the weight member comprises a first portion and a second portion, wherein the first portion is slideably affixed to the second portion such that the first portion slides towards the second portion when the weight member is locked in place.

In an additional non-limiting embodiment of the present technology the weight member comprises a third member; and wherein the width of the weight member decreases as the third member is rotated in a first direction.

In an additional non-limiting embodiment of the present technology rotation of the third member in a first direction forces the first member and the second member to squeeze the locking rail.

In an additional non-limiting embodiment of the present technology the weight receptacle is located on the sole.

In an additional non-limiting embodiment of the present technology the locking rail comprises a locking rail angle, the locking rail angle measured between a rail locking surface and the exterior surface of the body, wherein the locking rail angle is between 85 degrees and 15 degrees.

In an additional non-limiting embodiment of the present technology the first rail angle and the second rail angle are between 75 degrees and 25 degrees.

In an additional non-limiting embodiment of the present technology the first rail angle and the second rail angle are between 65 degrees and 35 degrees.

In an additional non-limiting embodiment of the present technology the third member comprises female threads configured to engage the second portion, wherein the third member comprises a tapered surface configured to engage the first portion, wherein rotation of the third member in a first direction forces the third member towards the golf club head and the first member, the tapered surface forcing the first member towards the locking rail.

BRIEF DESCRIPTION OF THE DRAWINGS

The accompanying drawings form a part of the specification and are to be read in conjunction therewith. The illustrated embodiments, however, are merely examples and are not intended to be limiting. Like reference numbers and designations in the various drawings indicate like elements.

DETAILED DESCRIPTION

Figure 1:
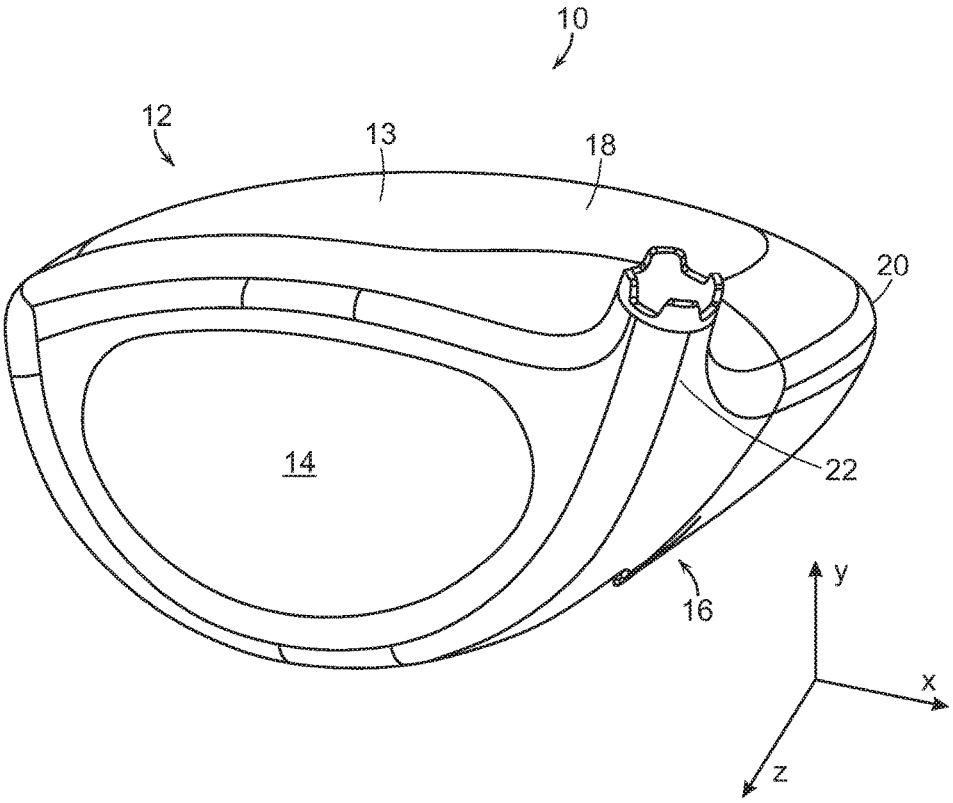
FIG. 1 illustrates a perspective view of a golf club head.

In the following detailed description, reference is made to the accompanying drawings, which form a part of the present disclosure. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, and designed in a wide variety of different configurations, all of which are explicitly contemplated and form part of this disclosure. For example, a system or device may be implemented or a method may be practiced using any number of the aspects set forth herein. In addition, such a system or device may be implemented or such a method may be practiced using other structure, functionality, or structure and functionality in addition to or other than one or more of the aspects set forth herein. Alterations and further modifications of inventive features illustrated herein, and additional applications of the principles of the inventions as illustrated herein, which would occur to one skilled in the relevant art and having possession of this disclosure, are to be considered within the scope of the invention.

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

In describing the present technology, the following terminology may have been used. The singular forms "a," "an," and "the" include plural referents unless the context clearly dictates otherwise. Thus, for example, reference to an item includes reference to one or more items. The term "plurality" refers to two or more of an item. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. A plurality of items may be presented in a common list for convenience. However, these lists should be construed as though each member of the list is individually identified as a separate and unique member. Thus, no individual member of such list should be construed as a de facto equivalent of any other member of the same lists solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to a selection of one of two or more alternatives, and is not intended to limit the selection of only those listed alternative or to only one of the listed alternatives at a time, unless the context clearly indicated otherwise.

Features of the present disclosure will become more fully apparent from the following description and appended claims, taken in conjunction with the accompanying drawings. After considering this discussion, and particularly after reading the section entitled "Detailed Description" one will understand how the illustrated features serve to explain certain principles of the present disclosure.

Embodiments described herein generally relate to systems, devices, and methods related to golf club heads having movable weight members. The golf club heads discussed herein are generally hollow metal wood type golf club heads, but may include any club head type, such as iron-type golf club heads. The inventive golf club heads generally include a movable weight member, the movable weight configured to be selectively locked into a plurality of positions in order to manipulate the location of the center of gravity of the golf club head to better suit a golfer's swing characteristics and optimize ball flight. The embodiments described herein are generally illustrated so that the weight member is attached at least partially to the sole for convenience, but one skilled in the art will appreciate that the weight member could be attached to other portions of the golf club head, which may include for example, the crown, the skirt, etc.

Figure 2:
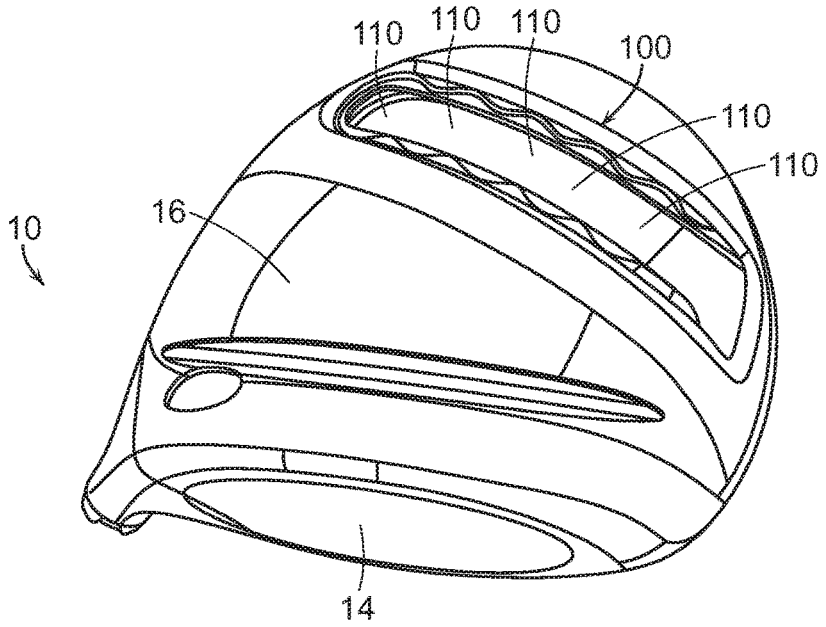
FIG. 2 illustrates a perspective view of the sole of the golf club head of FIG. 1.
Figure 3:
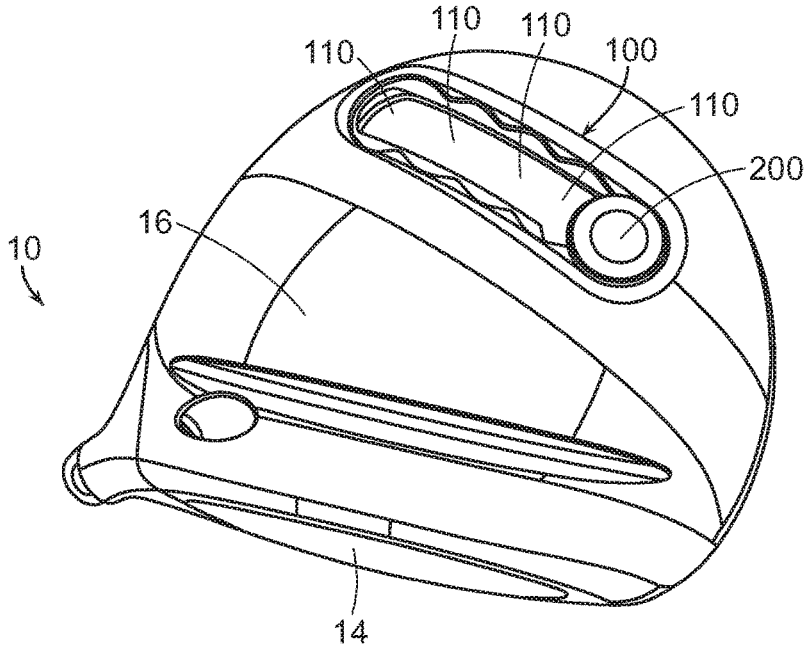
FIG. 3 illustrates a perspective view of the sole of an additional embodiment of a golf club head.

FIG. 1 illustrates a perspective view of a golf club head 10. Golf club head 10 includes a body 12 having a striking face 14, a sole 16, a crown 18, a skirt 20, and a hosel 22. The body 12 defines a hollow interior volume. The body also has an exterior surface 13, opposite the interior volume. FIG. 2 illustrates a perspective view of the sole 16 of the golf club head 10 of FIG. 1. FIG. 3 illustrates a perspective view of the sole 16 of an additional embodiment of a golf club head 10. The sole 16 generally provides the lower surface of the golf club head 10 when the golf club head 10 is placed in an address position. The golf club head 10 includes a weight receptacle 100 configured to receive and retain a weight member 200 (not illustrated in FIG. 2). The weight receptacle 100 is configured to selectively lock a weight member 200 in one of a plurality of lock positions 110, depending on where the golfer would prefer the weight member 200 to be located within the weight receptacle 100. The weight member 200 and weight receptacle 100 are configured to enable a golfer to alter the location of the CG of the golf club head 10 by manipulating the location of the weight member 200 within the weight receptacle 100.

The embodiments described herein are generally illustrated so that the weight receptacles 100 are at least partially located on the sole 16 for convenience. However, as will be appreciated by a person having ordinary skill in the art, weight receptacles 100 having the same structures as those described herein may be located on any portion of the golf club head 10, such as the crown 18 and/or skirt 20. Additionally, many embodiments of weight receptacles described herein are illustrated separate from the golf club head for convenience. However, as will be appreciated by a person having ordinary skill, weight receptacles 100 described herein are intended to be affixed to the golf club head 10 or formed integrally with the golf club head 10. The weight receptacles 100 could be affixed to the golf club head 10 in a variety of ways, which may include, for example, welding, brazing, adhesives, mechanical locks, fasteners, etc.

Figure 4:
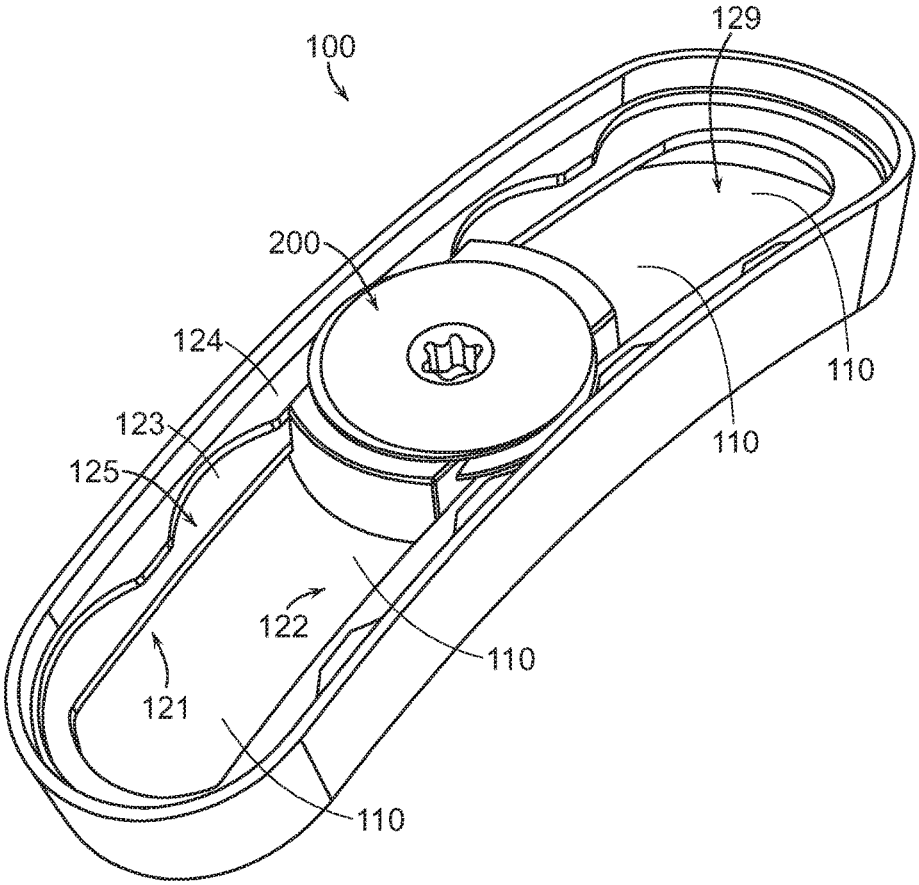
FIG. 4 illustrates a perspective view of an additional embodiment of a weight receptacle and weight member.
Figure 5:
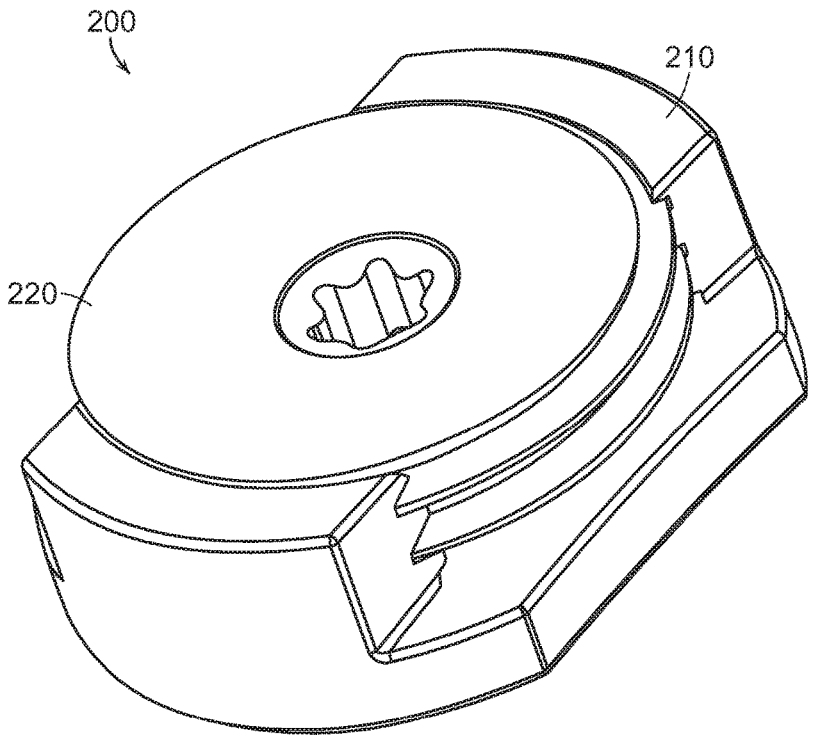
FIG. 5 illustrates a perspective view of the weight member of FIG. 4.
Figure 6:
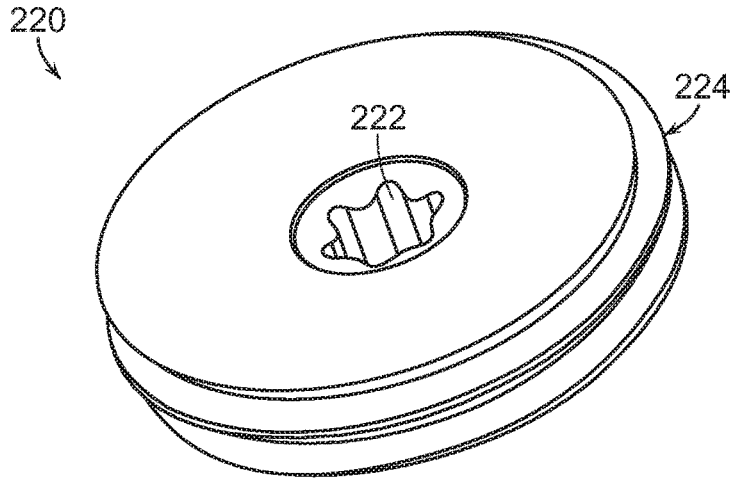
FIG. 6 illustrates a perspective view of the second portion of the weight member of FIG. 5.
Figure 7:
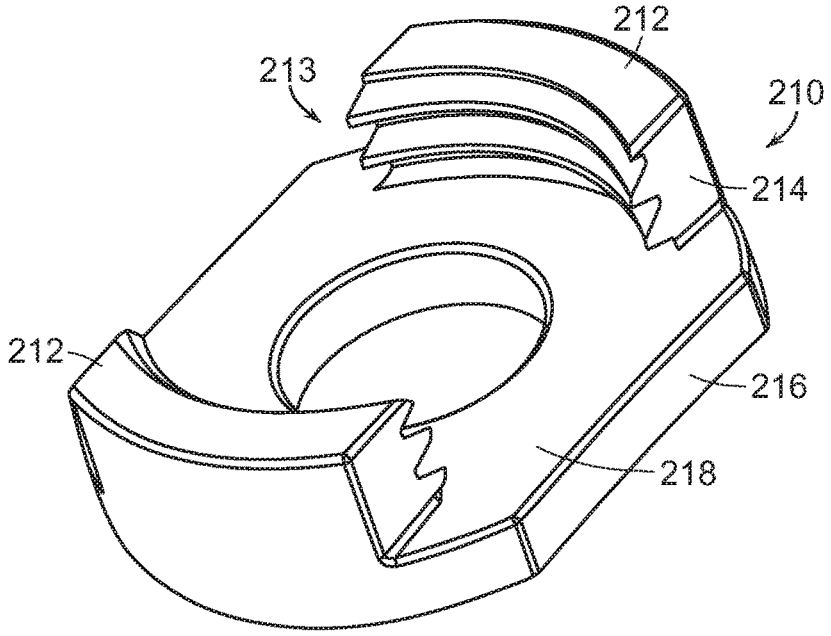
FIG. 7 illustrates a perspective of the first portion of the weight member of FIG. 5.

FIG. 4 illustrates a perspective view of an additional embodiment of a weight receptacle 100. Also illustrated in FIG. 4 is a weight member 200 locked into one of the plurality of locking positions 110. FIG. 5 illustrates a perspective view of the weight member 200 of FIG. 4. FIG. 6 illustrates a perspective view of the second portion 220 of the weight member 200 of FIG. 5. FIG. 7 illustrates a perspective of the first portion 210 of the weight member 200 of FIG. 5. The weight member 200 is able to slide along the weight receptacle 100 when the weight member 200 is unlocked and can be locked into any of the lock positions 110 by rotating a portion of the weight member 200 with a tool.

As illustrated in FIGS. 5-7, the first portion 210 is formed separately from the second portion 220, and the second portion 220 is configured to rotate relative to the first portion 210. The weight member 200 is configured to lock to the weight receptacle 100 by rotating the second portion 220 in a first direction relative to the first portion 210. The first portion includes a flange 216 and a pair of engagement members 212 extending up from the flange 216. The flange includes an abutment surface 218 configured to abut a portion of the weight receptacle 100. The engagement members 212 are configured to engage the second portion 220 to lock the weight member 200 in the weight receptacle 100. In the illustrated embodiment, the engagement members 212 include a threaded portion 213 configured to engage the second portion 220 of the weight member 200. The second portion includes a threaded portion 224 configured to engage the first portion 210 and lock the weight member 200 in the weight receptacle 100. The second portion 220 also includes a tool engagement feature 222 configured to receive a tool (not illustrated) so that the user can rotate the second portion 220 relative to the first portion 210.

Figure 8:
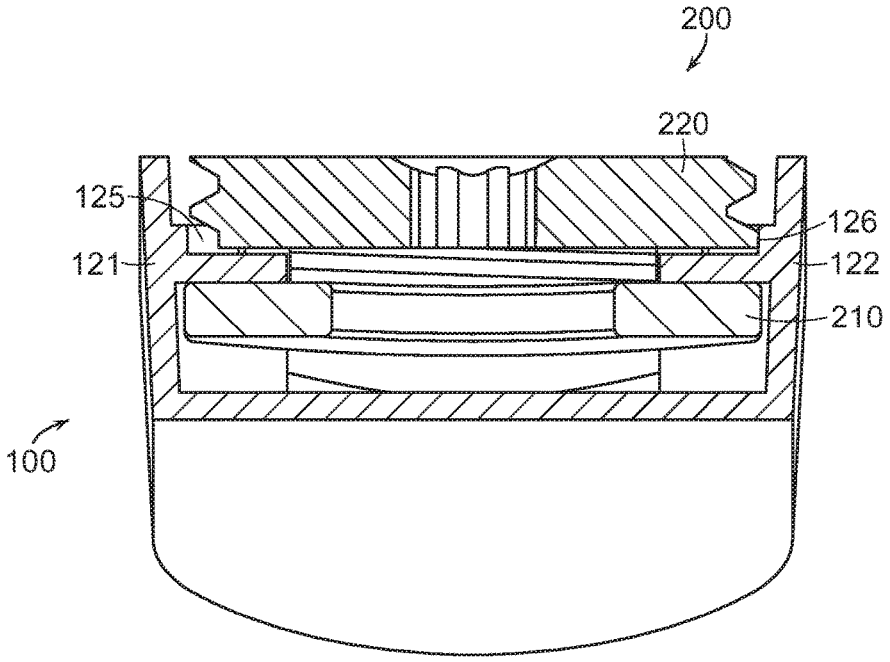
FIG. 8 illustrates a cross-sectional view of the weight receptacle and weight member of FIG. 4.
Figure 9:
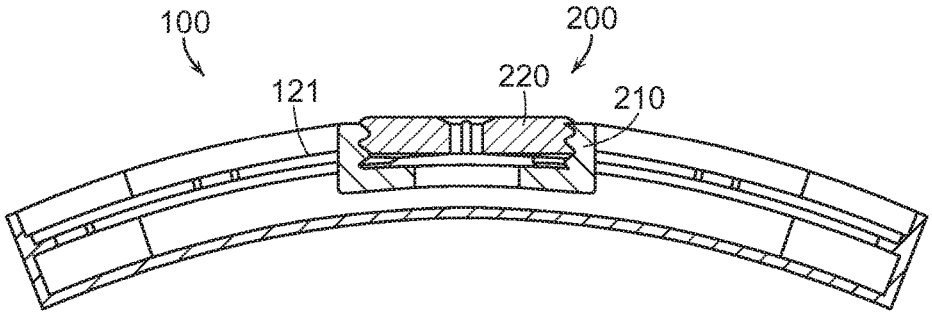
FIG. 9 illustrates an additional cross-sectional view of the weight receptacle and weight member of FIG. 4.

FIG. 8 illustrates a cross-sectional view of the weight receptacle 100 and weight member 200 of FIG. 4. FIG. 9 illustrates an additional cross-sectional view of the weight receptacle 100 and weight member 200 of FIG. 4. As illustrated in FIGS. 4, 8, and 9, the weight receptacle 100 includes a first locking rail 121, on a first side of the weight receptacle 100, which runs along the length of the weight receptacle 100 and a second locking rail 122, on a second side of the weight receptacle 100, which runs along the length of the weight receptacle 100. The first locking rail 121 and second locking rail 122 are configured to releasably couple the weight member 200 to the weight receptacle 100. The weight member 200 is configured to lock to the weight receptacle 100 by engaging the first locking rail 121 and the second locking rail 122. At least a portion of the weight member 200 is configured to reside between the first locking rail 121 and the second locking rail 122. The second portion 220 of the weight member 200 is configured to rotate relative to the first portion 210, and as the second portion 220 rotates, the threaded portion 224 engages the threaded portion 213 of the first portion, causing the second portion 220 to translate towards the abutment surface 218 of the first portion. When the second portion 220 is rotated in a first direction, a portion of the first locking rail 121 and a portion of the second locking rail 122 is sandwiched between the first portion 210 and second portion 220 of the weight member 200, locking the weight member 200 in place in the weight receptacle 100. Additionally, the first portion 210 of the weight member includes slide walls 214 configured to slide along the weight receptacle 100 and prevent the first portion 210 of the weight member 200 from rotating relative to the weight receptacle 100.

Additionally, the flange portion 216 of the weight member 200 is configured to have a width greater than that of the channel 129 created between the first locking rail 121 and the second locking rail 122 of the weight receptacle 200. The flange portion 216 prevents the weight member 200 from falling out of the weight receptacle 200 even when the weight member 200 is unlocked by rotating the second member 220 in a second direction, opposite the first direction. This conveniently retains the weight member 200 in the weight receptacle 100 but allows the user to slide the weight member 200 along the weight receptacle 100 to a different lock position 110 when the weight member 200 is unlocked.

As illustrated in FIG. 4, the locking rails 121, 122 also include a plurality of locking recesses 125 located adjacent each locking position 110 configured to aid in locking the weight member 200 in place in the weight receptacle 100. The locking recesses 125 are regions of the locking rails 121, 122 which have reduced thickness, creating thin portions 123 and thick portions 124 of the locking rails 121, 122. The locking recesses 125 create a locking wall 126 which the weight member 200 abuts when locked into the locking position 110, preventing the weight member from sliding within the weight receptacle 100 when the weight member 200 is in a locked position. As illustrated in FIGS. 4 and 8, the second portion 220 of the weight member 200 can reside in the locking recess 125 when the weight member 200 is in a locked position. When the user wants to unlock the weight member 200, they can rotate the second member in a second direction, moving the second portion 220 away from the first portion 210 and out of the locking recess 125, allowing the weight member 200 to slide along the weight receptacle 100 to a different lock position 110.

Figure 10:
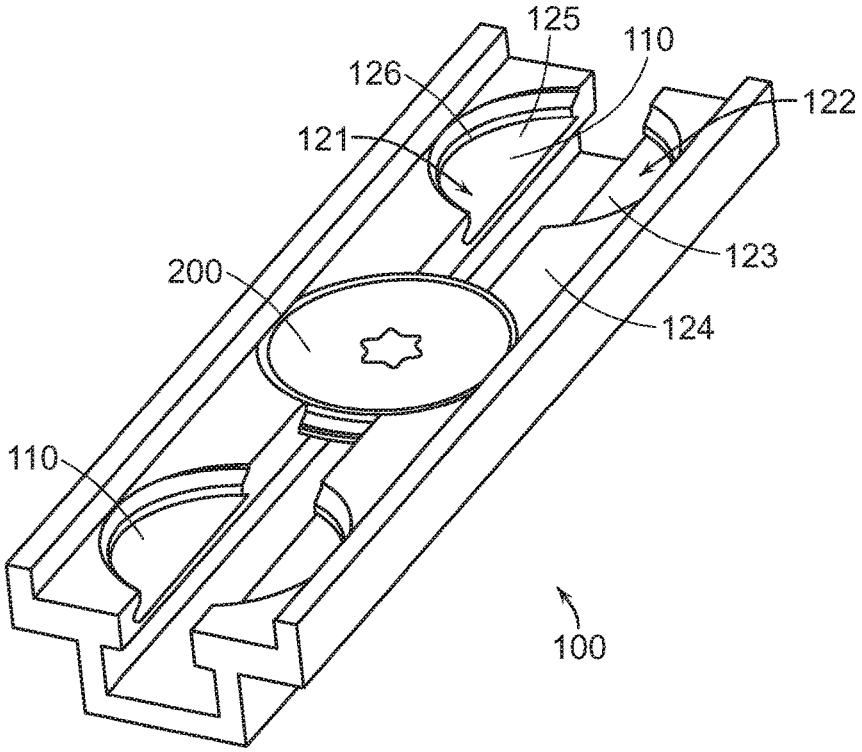
FIG. 10 illustrates perspective view of an additional embodiment of a weight receptacle and a weight member.
Figure 11:
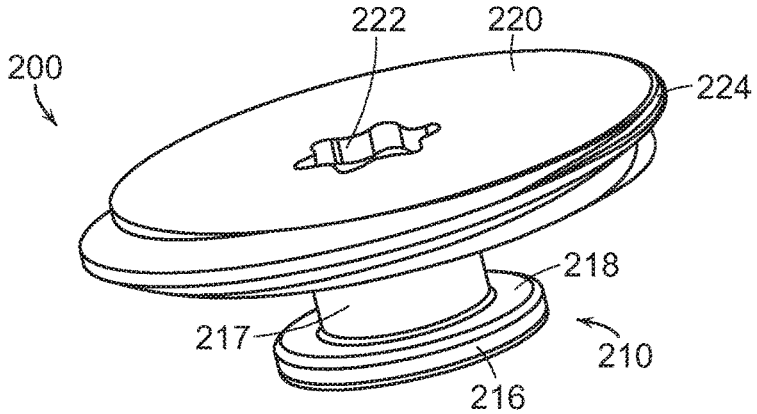
FIG. 11 illustrates a perspective view of the weight member of FIG. 10.
Figure 12:
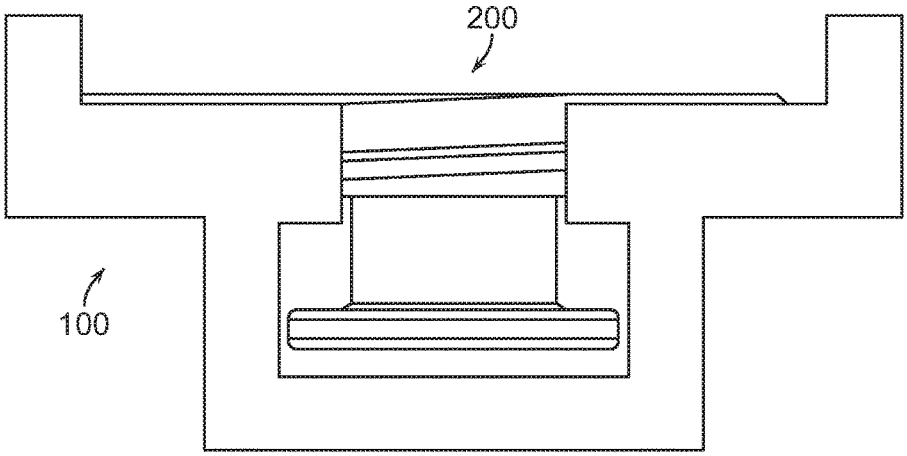
FIG. 12 illustrates an end view of the weight receptacle and a weight member of FIG. 10.
Figure 13:
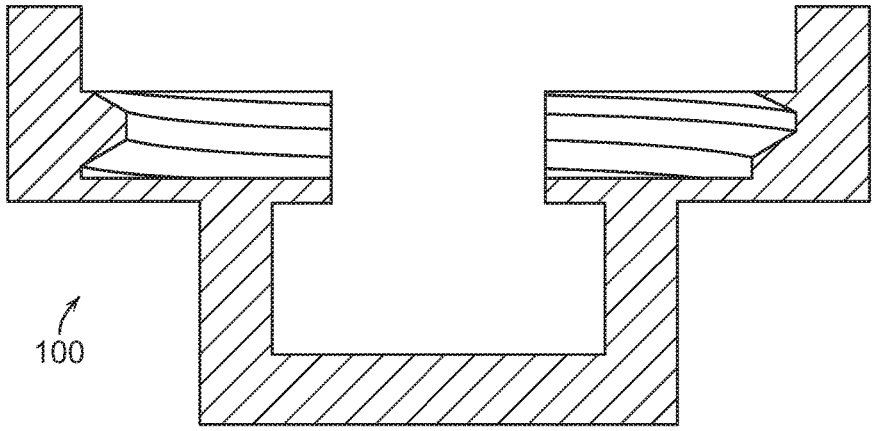
FIG. 13 illustrates a cross sectional view of the weight receptacle of FIG. 10.

FIG. 10 illustrates perspective view of an additional embodiment of a weight receptacle 100 and a weight member 200. FIG. 11 illustrates a perspective view of the weight member 200 of FIG. 10. FIG. 12 illustrates an end view of the weight receptacle 100 and a weight member 200 of FIG. 10. FIG. 13 illustrates a cross sectional view of the weight receptacle 100 of FIG. 10. The weight receptacle 100 and weight member 200 are similar to the embodiments illustrated in FIGS. 4-9 but include a few key differences. The weight member 200 includes a second portion 220 which includes a threaded portion 224, which is configured to engage the weight receptacle 100. The weight member 200 also includes a first portion 210 including a flange 216 located below the second portion 220 and affixed to the second portion 220 via an extension member 217. In this embodiment, the first portion 210 is either formed integrally with the second portion 220 or permanently affixed such that they rotate together.

The weight receptacle 100 includes a plurality of lock positions 110. The weight receptacle also includes a first locking rail 121 and a second locking rail 122. Each locking rail 121, 122, includes locking recesses 125 at each lock position 110. The locking recesses 125 create thin portions 123 and thick portions 124 of the locking rails 121, 122. The locking recesses 125 create a locking wall 126, which as illustrated in FIGS. 10 and 13, are threaded to engage the threaded portion 224 of the weight member 200. The weight member 200 can be locked into the weight receptacle 200 by rotating the weight member 200 in a first direction so that the threaded portion 224 engages the threaded locking wall 126 of the weight receptacle 100 and the second portion 220 of the weight member abuts the thin portion 123 of the locking rails 121, 122. Alternatively, the flange could abut the lower surface of the weight receptacle 100.

Additionally, the flange 216 is configured to have a width greater than the channel formed between the first locking rail 121 and the second locking rail 122. The flange portion 216 prevents the weight member 200 from falling out of the weight receptacle 200 even when the weight member 200 is unlocked. The extension member 217 includes enough length such that the weight member 200 can be unlocked to disengage the threaded portion 224 from the threaded locking wall 126 of the weight receptacle and allow the weight member 200 to slide along the weight receptacle 100 to another lock position 110.

Figure 14:
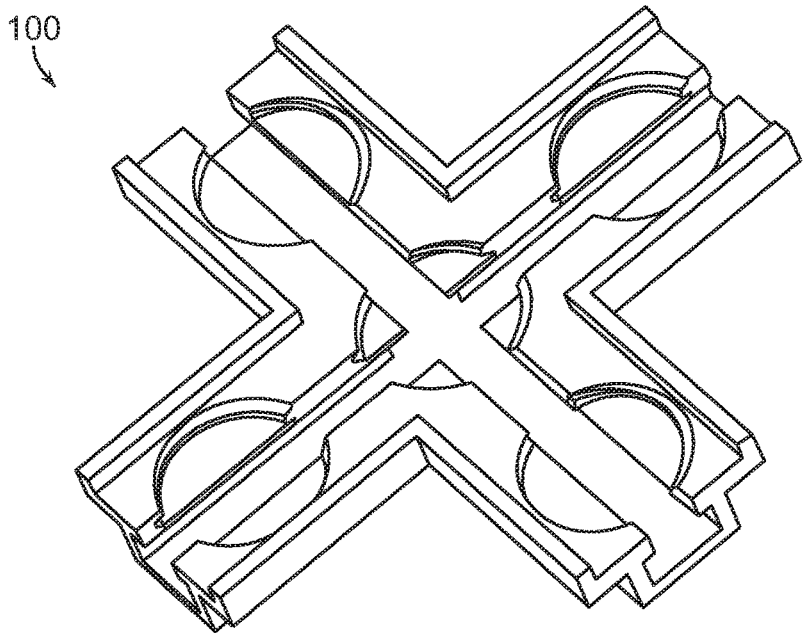
FIG. 14 illustrates a perspective view of an additional embodiment of a weight receptacle.
Figure 15:
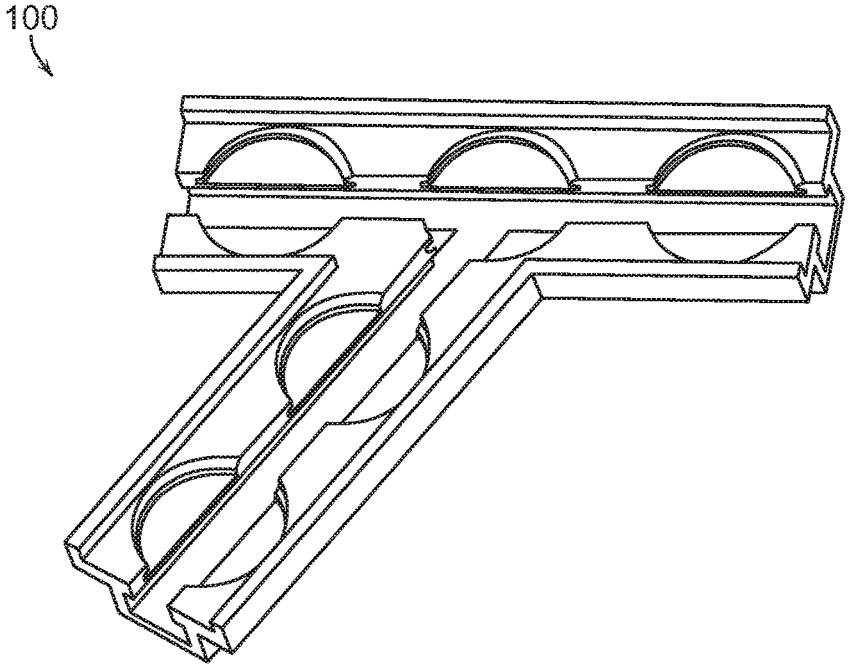
FIG. 15 illustrates a perspective view of an additional embodiment of a weight receptacle.

FIG. 14 illustrates a perspective view of an additional embodiment of a weight receptacle 100. FIG. 15 illustrates a perspective view of an additional embodiment of a weight receptacle 100. As illustrated in FIGS. 14 and 15, the weight receptacle can allow for the weight member 200 to be moved along more than one axis, providing even more capability for adjustment of the location of the CG of the golf club head.

Figure 16:
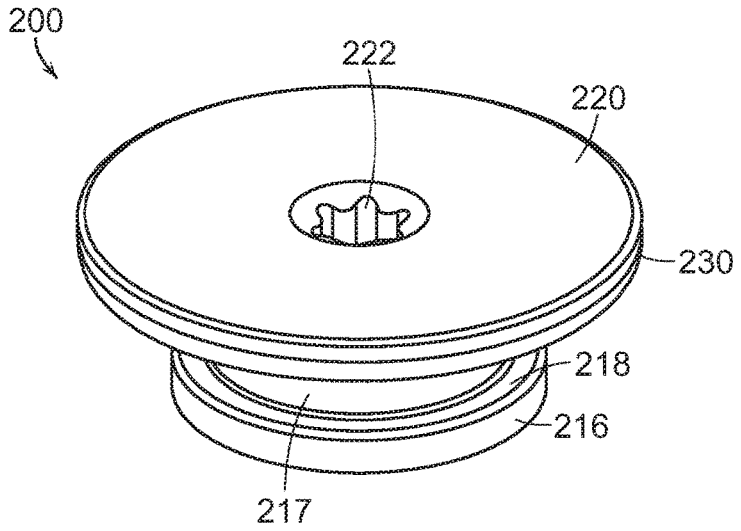
FIG. 16 illustrates a perspective view of an additional embodiment of a weight member.
Figure 17:
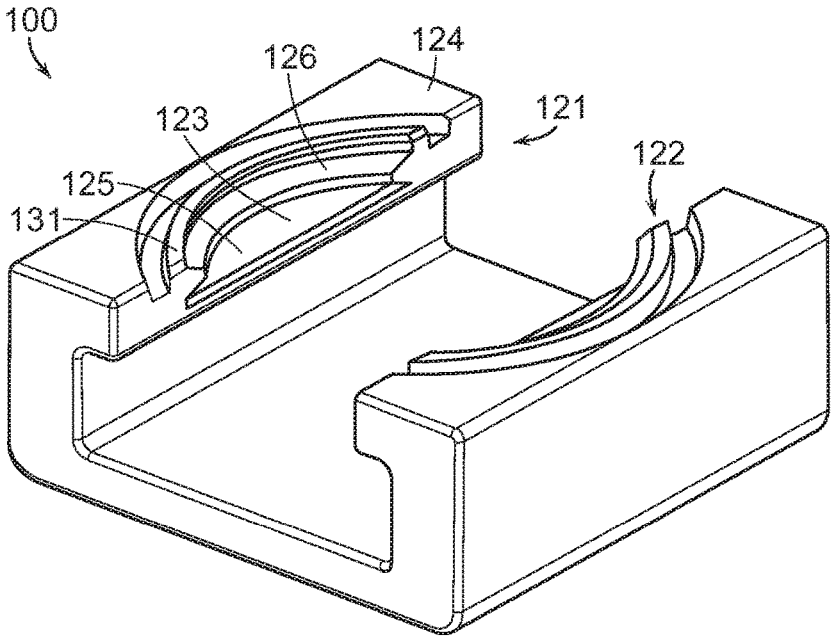
FIG. 17 illustrates a perspective view of a portion of an additional embodiment of a weight receptacle.
Figure 18:
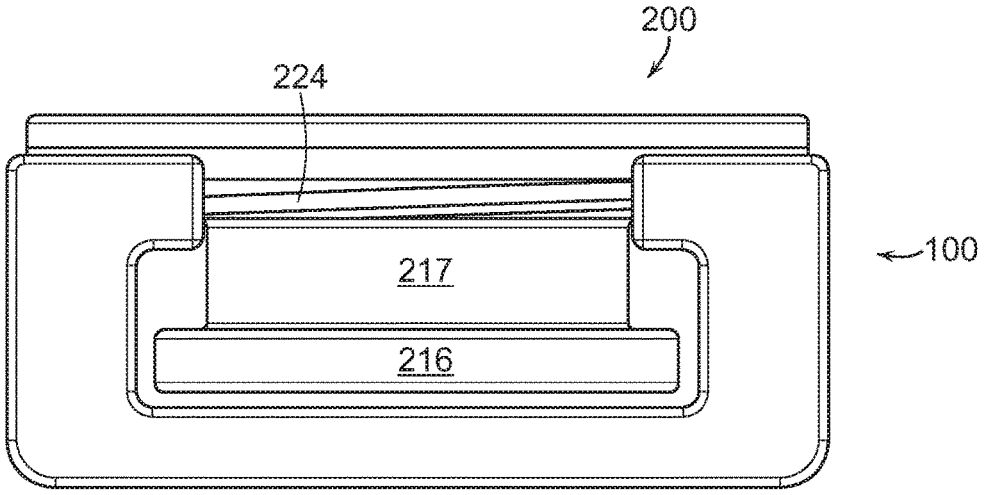
FIG. 18 illustrates an end view of the weight member 200 of FIG. 16 and the weight receptacle of FIG. 17.
Figure 19:
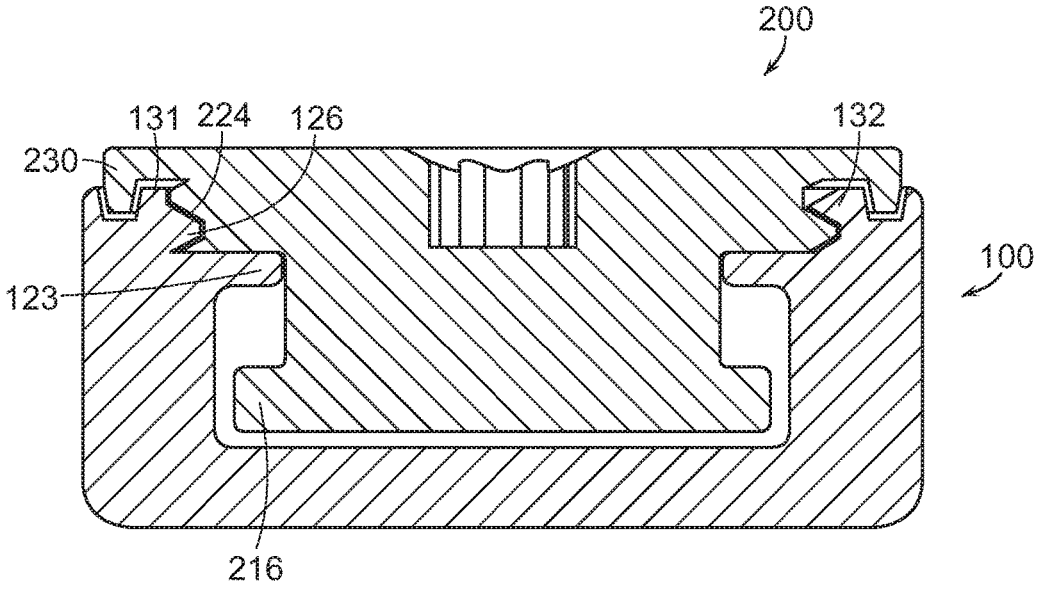
FIG. 19 illustrates a cross-sectional view of the weight member and weight receptacle of FIG. 18.

FIG. 16 illustrates a perspective view of an additional embodiment of a weight member 200. FIG. 17 illustrates a perspective view of a portion of an additional embodiment of a weight receptacle 100. FIG. 18 illustrates an end view of the weight member 200 of FIG. 16 and the weight receptacle 100 of FIG. 17. FIG. 19 illustrates a cross-sectional view of the weight member 200 and weight receptacle 100 of FIG. 18.

The weight receptacle 100 and weight member 200 are similar to the embodiments illustrated in FIGS. 10-13, but include a few key differences. As illustrates in FIGS. 17 and 19, the locking rails 121, 122, include retention rails 131, 132 which extend upwards, substantially parallel to the axis of rotation of the weight member 200. The weight member 200 includes an engagement member 230 configured to extend around and abut the retention rails 131, 132. One challenge with weight receptacles can be the tendency of the weight receptacle to flex or deform when the golf club head strikes a golf ball. In the illustrated embodiments herein, the weight member 200 generally prevents the first locking rail 121 from deflecting towards the second locking rail 121, since it is lodged between the two locking rails 121, 122. However, during violent impacts with a golf ball the golf club head can flex and cause the first locking rail 121 to deform away from the second locking rail 122. By providing the retention rails 131, 132 described above and locking the weight member 200 in place, the engagement member 230 can engage the retention rails 131, 132, and the weight member 200 can limit the amount the first locking rail 121 can travel away from the second locking rail 122. This is particularly important because if the locking rails 121, 122 spread apart during impact, this can cause the weight member 200 to loosen and become unlocked. The engagement member 230 engaging the retention rails 131, 132 can help to prevent this phenomenon from happening while minimizing the weight of the weight receptacle 200.

Figure 20:
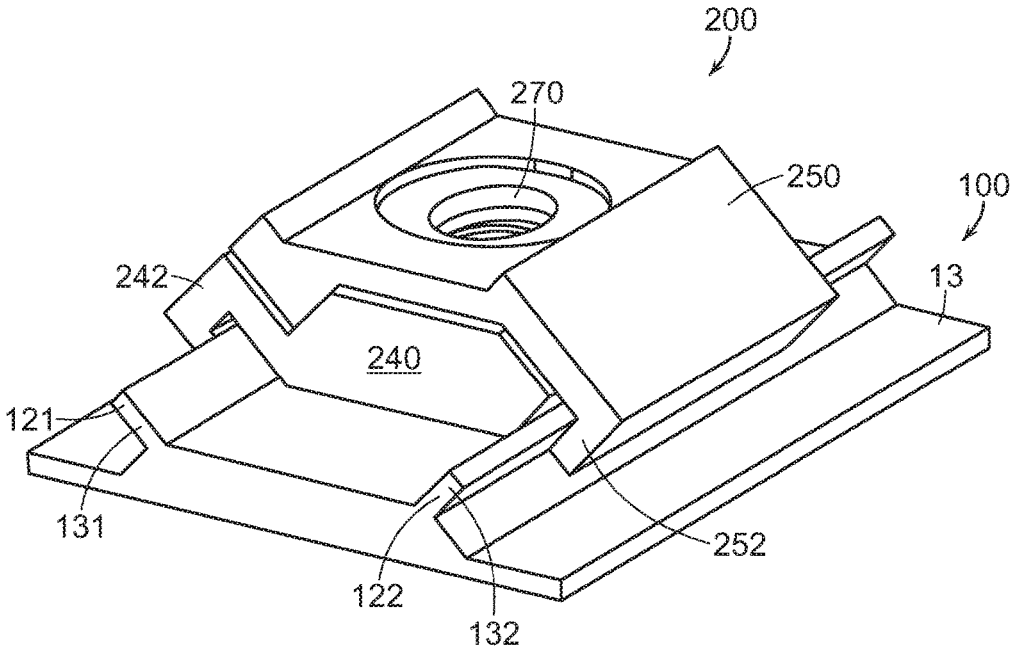
FIG. 20 illustrates a partial perspective view of additional embodiments of a weight receptacle and a weight member.
Figure 21:
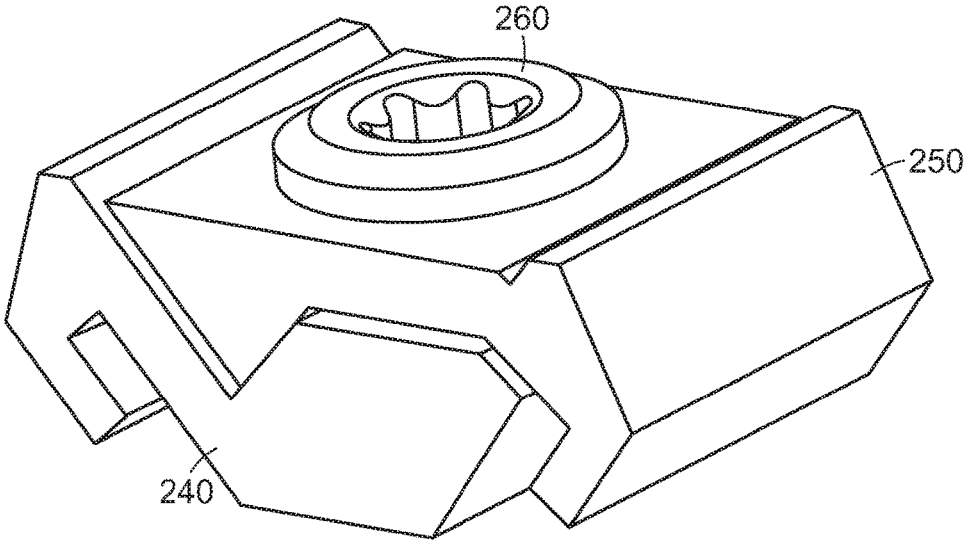
FIG. 21 illustrates a perspective view of the weight member of FIG. 20.
Figure 22:
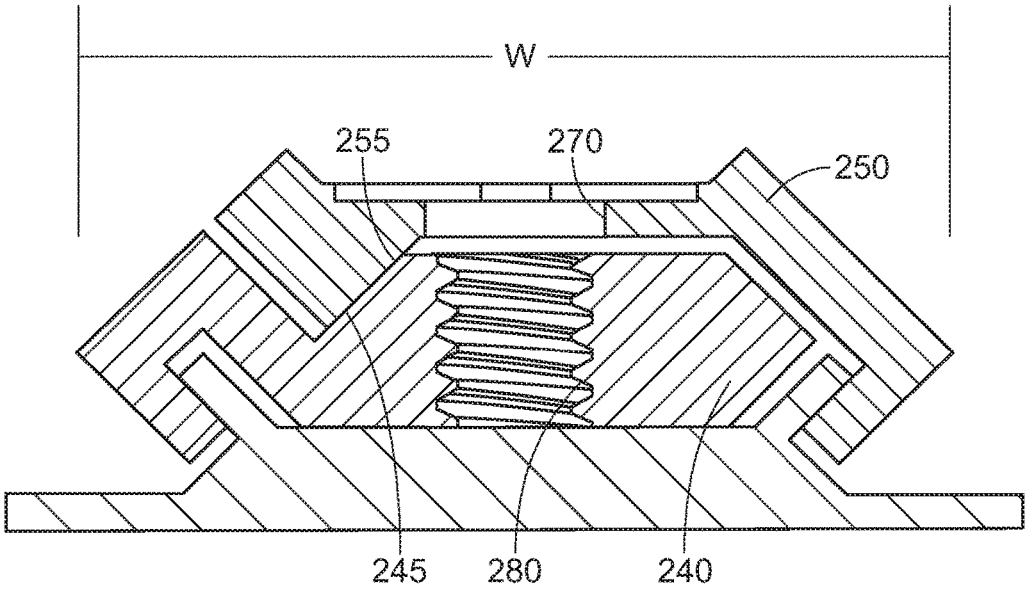
FIG. 22 illustrates a cross-sectional view of the weight member of FIG. 20.

FIG. 20 illustrates a partial perspective view of additional embodiments of a weight receptacle 100 and a weight member 200. FIG. 21 illustrates a perspective view of the weight member 200 of FIG. 20. FIG. 22 illustrates a cross-sectional view of the weight member 200 of FIG. 20. The weight receptacle 200 includes a first locking rail 121 and a second locking rail 122, each running the length of the weight receptacle, the locking rails 121, 122 configured to engage the weight member 200 and lock it in place. In the embodiments illustrated in FIGS. 20-24, the locking rails 121, 122, also perform the role of the retention rails 131, 132 described above. The locking rails 121, 122 are capable of not only slideably retaining the weight member 200 when it is in an unlocked position and locking the weight member 200 to the weight receptacle 100 when the weight member 200 is in a locked position, but they also engage the weight member 200 when the weight member 200 is in a locked position in order to limit deformation of the weight receptacle 100 during golf ball impact. The locking rails 121, 122 can be substantially linear as illustrated in FIGS. 20 and 22. Additionally, the locking rails 121 can be formed at an angle as illustrated in FIGS. 20 and 22.

The weight member 200 includes a first member 240, a second member 250, and a third member 260. The first member 240 includes an engagement member 242 configured to engage the first locking rail 121 when the weight member 200 is in a locked position. The second member 250 includes an engagement member 252 configured to engage the second locking rail 122 when the weight member 200 is in a locked position. The first member 240 includes an angled abutment surface 245 configured to engage the second member 250. The second member 255 includes an angled abutment surface 255 configured to engage the first member 240. Additionally, the first member 240 includes a threaded bore 280. The second member 250 includes a through bore 270. The third member 260 can be a threaded fastener configured to pass through the through bore 280 and engage the threaded bore 280. To lock the weight member 200 in place, the third member 260 is rotated in a first direction, the third member 260 compressing the second member 250 toward the second member 240 along the axis of rotation of the third member. The angled abutment surfaces 245, 255 are configured such that the first member 240 moves towards the second locking rail 122 and the second member moves towards the first locking rail 121 as the third member is rotated in a first direction, allowing the first engagement member 242 to engage the first locking rail 121 and the second engagement member 252 to engage the second locking rail 122, locking the weight member 200 in place in the weight receptacle 100. As illustrated in FIG. 22, the weight member has a width W, when the weight member 200 is in a locked position the width W is smaller than when said weight member 200 is in an unlocked position.

Additionally, the weight member 200 engages the locking rails 121, 122 in such a manner that it limits the weight receptacle from deforming and forcing the first locking rail 121 away from the second locking rail 122, minimizing chances of the weight member 200 from incidentally coming unlocked due to the golf club head impacting a golf ball. It is also worth noting that the through bore 270 has a larger diameter than the third member 260 to allow the first member 240 to translate relative to the second member 250.

Figure 23:
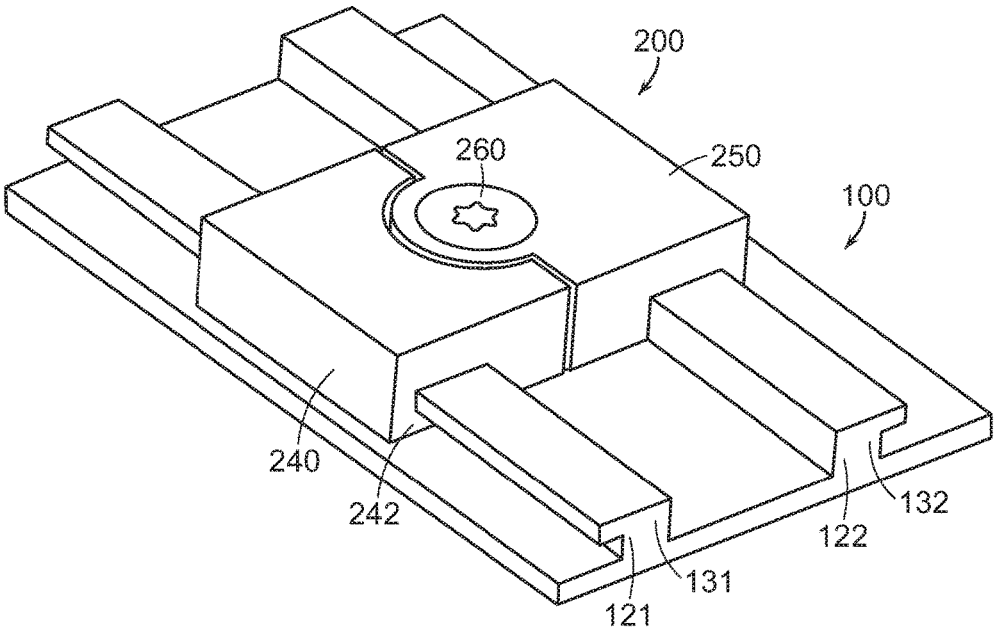
FIG. 23 illustrates a partial perspective view of additional embodiments of a weight receptacle and a weight member.
Figure 24:
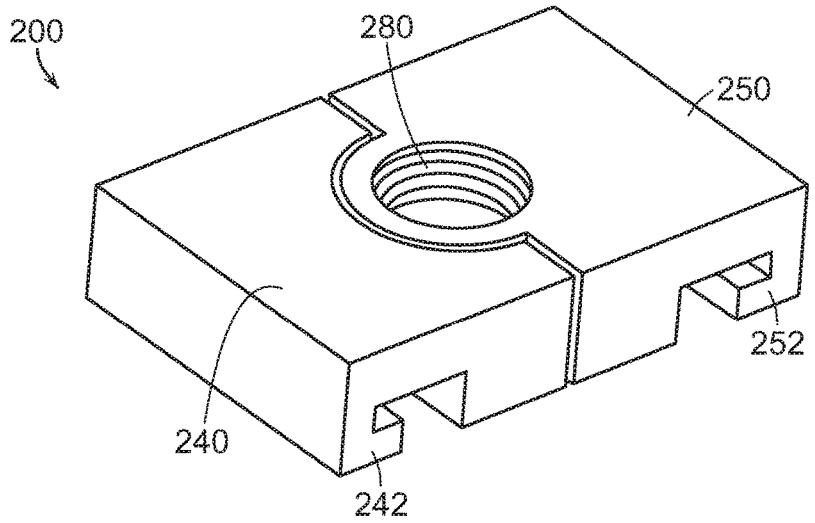
FIG. 24 illustrates a perspective view of the weight member of FIG. 23.
Figure 25:
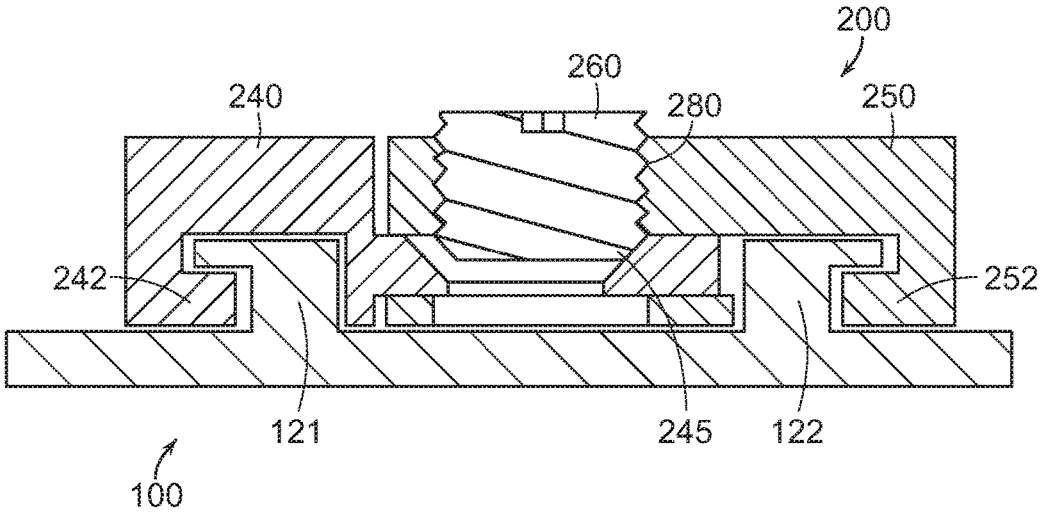
FIG. 25 illustrates a cross-sectional view of the weight member of FIG. 24.

FIG. 23 illustrates a partial perspective view of additional embodiments of a weight receptacle 100 and a weight member 200. FIG. 24 illustrates a perspective view of the weight member 200 of FIG. 23. FIG. 25 illustrates a cross-sectional view of the weight member 200 of FIG. 24. The weight receptacle 100 and weight member 200 are similar to the embodiments illustrated in FIGS. 20-22 but include a few key differences. The locking rails 121, 122 in the present embodiment are L-shaped rather than substantially linear and angled like in FIGS. 20-22. Accordingly, the engagement members 242, 252 are shaped and configured to engage the locking rails 121, 122. Additionally, the way the third member 260 interacts with the first member 240 and second member 250 is different. The second member 250 includes a threaded bore 280 configured to engage the third member 260. The first member 240 includes an angled abutment surface 245 configured to engage the third member 260. The third member 260 in the present embodiment is a set screw with a tapered end configured to engage the angled abutment surface 245 of the first member. As the third member 260 is rotated in a first direction, it translates along its axis of rotation towards weight receptacle 100. The taper of the third member 260 engages the angled abutment surface 245 of the first member 240, causing the first member to translate towards the second locking rail 122 and the second member 250 to translate towards the first locking rail 121. Thus, rotating the third member 260 in the first direction causes the first engagement member 242 to engage the first locking rail 121 and the second engagement member 252 to engage the second locking arm 122, locking the weight member 200 in place in the weight receptacle 100.

It is important to note that the embodiments illustrated in FIGS. 20-22 could include the locking rails 121,122 of FIGS. 23-25. Additionally the embodiments illustrated in FIGS. 23-25 20-22 could include the locking rails 121,122 of FIGS. 20-22. Furthermore, the embodiments illustrated in FIGS. 20-22 could include the abutment surfaces and third member of FIGS. 23-25. Additionally, the embodiments illustrated in FIGS. 23-25 could include the abutment surfaces and third member of FIGS. 20-22. Most importantly, any of the features described herein in any of the embodiments could be applied to any of the other embodiments described herein without departing from the scope of this disclosure.

Figure 26:
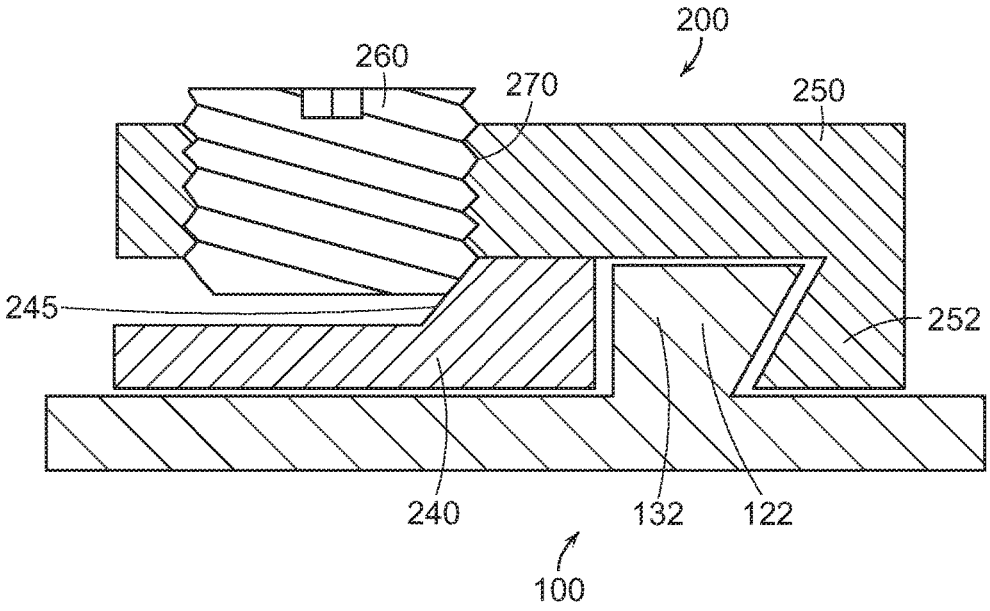
FIG. 26 illustrates a cross-sectional view of an additional embodiment of a weight receptacle and a weight member.

FIG. 26 illustrates a cross-sectional view of an additional embodiment of a weight receptacle 100 and a weight member 100. Unlike the embodiments illustrated in FIGS. 20-25, this weight receptacle 100 only includes a single locking rail. Additionally, the locking rail 122 is tapered in thickness. The third member 260 is rotated in a first direction and engaged the angled abutment surface 245 of the first member, causing the first member to translate towards the locking rail 122 and the first member 240 and the engagement member 252 to compress towards the locking rail 122, locking the weight member 200 in place to the weight receptacle 100.

Figure 27:
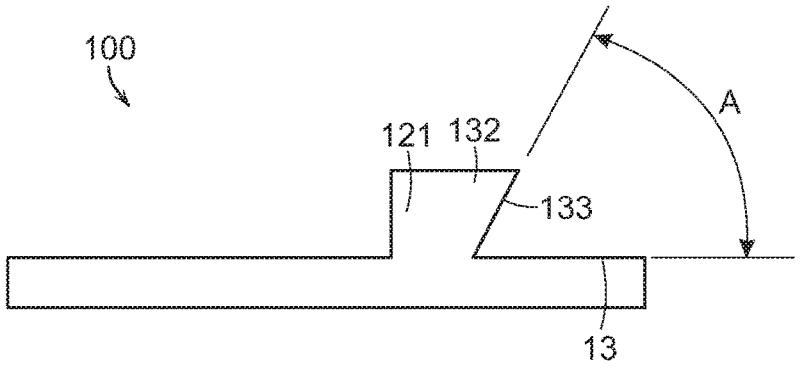
FIG. 27 illustrates an end view of the weight receptacle of FIG. 26.

FIG. 27 illustrates an end view of the weight receptacle 100 of FIG. 26. The locking rail 132 includes a rail locking surface 133 configured to abut the engagement member 252 of the weight member 200. In some embodiments, as illustrated in FIGS. 20, 26, and 27, the rail locking surface 133 can be angled relative to the bottom of the weight receptacle, which in some embodiments, and as illustrated in FIG. 27 may be a portion of the sole 16, and in other embodiments may be another exterior surface 13 of the golf club head. In some embodiments, the rail angle A between the locking surface and the exterior surface 13, is between 85 and 15 degrees. In an additional embodiment, the rail angle A between the locking surface 133 and the exterior surface 13, is between 75 and 25 degrees. In an additional embodiment, the rail angle A between the locking surface and the exterior surface 13, is between 65 and 35 degrees. In an additional embodiment, the rail angle A between the locking surface and the exterior surface 13, is between 55 and 45 degrees.

Figure 28:
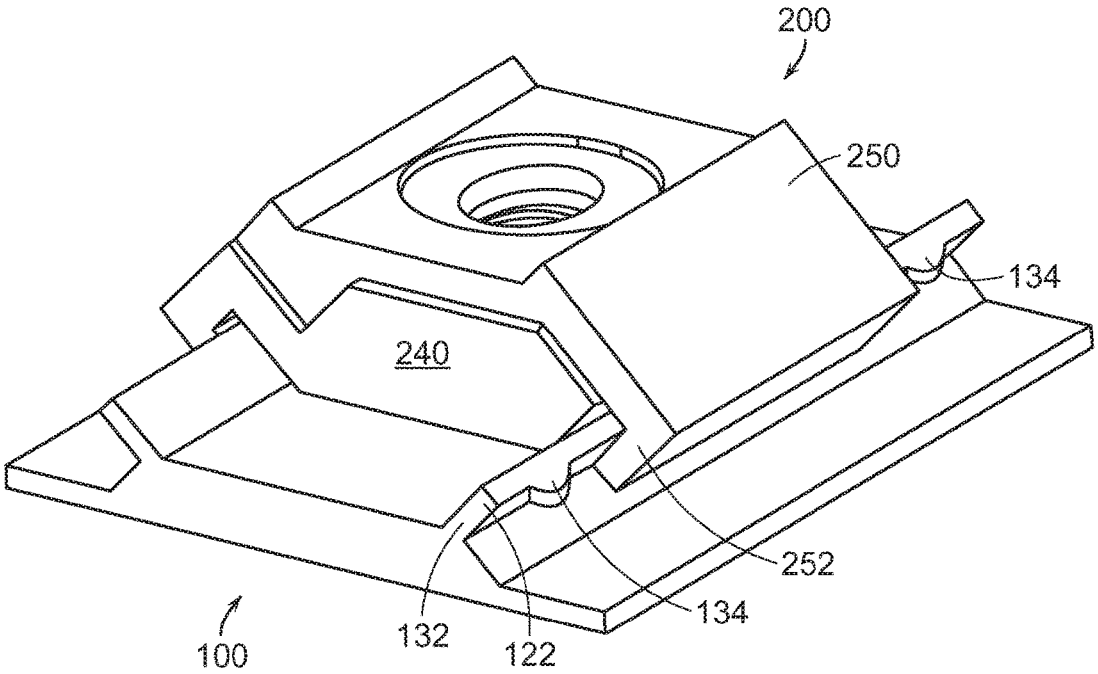
FIG. 28 illustrates a perspective view of an additional embodiment of the weight receptacle and a weight member of FIG. 20.

FIG. 28 illustrates a perspective view of an additional embodiment of the weight receptacle 100 and a weight member 200 of FIG. 20. This embodiment includes a plurality of protrusions 134 extending outwards from the locking surface 133 of the locking rail 132 configured to engage the weight member 200. These protrusions can help to limit movement of the weight member 200 when the weight member is in a locked position. The engagement member 252 can also include complimentary recesses (not illustrated) configured to engage the protrusions. In an additional embodiment (not illustrated), the locking rail 132 can include recesses and the engagement member can include protrusions configured to engage the recesses when the weight member 200 is in a locked position.

In describing the present technology herein, certain features that are described in the context of separate implementations also can be implemented in combination in a single implementation. Conversely, various features that are described in the context of a single implementation also can be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure as well as the principle and novel features disclosed herein.

We claim:

1. A golf club head, comprising:

a body having a face, a sole, a crown, and a skirt joining said face, sole and crown;

a hollow golf club interior within said body;

said body having an exterior surface opposite said hollow golf club interior;

said body having a coordinate system with an x-axis located horizontal to the club face, a y-axis located vertical to the club face, and a z-axis located through the club face;

said body having a center of gravity;

wherein said body comprises an elongate weight receptacle, said weight receptacle comprising:

a first locking rail extending from said exterior surface of said body, said first locking rail running along a first side of said weight receptacle;

a second locking rail extending from an exterior surface of said body, said second locking rail running along a second side of said weight receptacle, said first locking rail spaced from said second locking rail;

wherein said first locking rail comprises a first rail angle, said first rail angle measured between a first rail locking surface and said exterior surface of said body, said second locking rail comprises a second rail angle, said second rail angle measured between a second rail locking surface and said exterior of said body, wherein said first rail angle and said second rail angle are between 85 degrees and 15 degrees;

a weight member located in said weight receptacle;

wherein said weight member is configured to slide along said weight receptacle when said weight member is in an unlocked position and said weight member is configured to lock in place in said weight receptacle when said weight member is in a locked position;

wherein said weight member at least partially resides between said first locking rail and said second locking rail;

wherein said weight member has a width, and wherein said width of said weight member is greater when said weight member is in an unlocked position than when said weight member is in a locked position;

wherein said weight member comprises a first portion and a second portion, wherein said first portion is slideably affixed to said second portion such that said first portion slides towards said second portion when said weight member is locked in place;

wherein said weight member comprises a third portion; and wherein said width of said weight member decreases as said third portion is rotated in a first direction;

wherein said weight member forces said first locking rail towards said second locking rail when said weight member is locked in place;

wherein said first portion comprises a first engagement member, wherein said second portion comprises a second engagement member, wherein said first engagement member engages said first locking surface of said first locking rail and said second engagement member engages said second locking surface of said second locking rail when said weight member is in a locked position;

wherein said weight receptacle is located on said sole.

2. A golf club head, comprising:

a body having a face, a sole, a crown, and a skirt joining said face, sole and crown;

a hollow golf club interior within said body;

said body having an exterior surface opposite said hollow golf club interior;

said body having a coordinate system with an x-axis located horizontal to the club face, a y-axis located vertical to the club face, and a z-axis located through the club face;

said body having a center of gravity;

wherein said body comprises an elongate weight receptacle, said weight receptacle comprising:

a first locking rail extending from said exterior surface of said body, said first locking rail running along a first side of said weight receptacle;

a second locking rail extending from said exterior surface of said body, said second locking rail running along a second side of said weight receptacle, said first locking rail spaced from said second locking rail;

a weight member located in said weight receptacle;

wherein said weight member is configured to slide along said weight receptacle when said weight member is in an unlocked position and said weight member is configured to lock in place in said weight receptacle when said weight member is in a locked position;

wherein said weight member at least partially resides between said first locking rail and said second locking rail;

wherein said weight member has a width, and wherein said width of said weight member is greater when said weight member is in an unlocked position than when said weight member is in a locked position.

3. The golf club head of claim 2, wherein said weight member comprises a first portion and a second portion, wherein said first portion is slideably affixed to said second portion such that said first portion slides towards said second portion when said weight member is locked in place.

4. The golf club head of claim 3, wherein said weight member comprises a third portion; and wherein said width of said weight member decreases as said third portion is rotated in a first direction.

5. The golf club head of claim 3, wherein said first portion comprises a first engagement member, wherein said second portion comprises a second engagement member, wherein said first engagement member engages said first locking rail and said second engagement member engages said second locking rail when said weight member is in a locked position.

6. The golf club head of claim 3, wherein said first portion comprises a first engagement member, wherein said second portion comprises a second engagement member, wherein said first engagement member engages said first locking surface of said first locking rail and said second engagement member engages said second locking surface of said second locking rail when said weight member is in a locked position.

7. The golf club head of claim 2, wherein said weight member forces said first locking rail towards said second locking rail when said weight member is locked in place.

8. The golf club head of claim 2, wherein said weight receptacle is located on said sole.

9. The golf club head of claim 2, wherein said first locking rail comprises a first rail angle, said first rail angle measured between a first rail locking surface and said exterior surface of said body, said second locking rail comprises a second rail angle, said second rail angle measured between a second rail locking surface and said exterior of said body, wherein said first rail angle and said second rail angle are between 85 degrees and 15 degrees.

10. The golf club head of claim 9, wherein said first rail angle and said second rail angle are between 75 degrees and 25 degrees.

11. The golf club head of claim 9, wherein said first rail angle and said second rail angle are between 65 degrees and 35 degrees.

12. A golf club head, comprising:

a body having a face, a sole, a crown, and a skirt joining said face, sole and crown;

a hollow golf club interior within said body;

said body having an exterior surface opposite said hollow golf club interior;

said body having a coordinate system with an x-axis located horizontal to the club face, a y-axis located vertical to the club face, and a z-axis located through the club face;

said body having a center of gravity;

wherein said body comprises an elongate weight receptacle, said weight receptacle comprising:

a locking rail extending from said exterior surface of said body, said locking rail running along a first side of said weight receptacle;

a weight member slideably affixed to said locking rail;

wherein said weight member is configured to slide along said weight receptacle when said weight member is in an unlocked position and said weight member is configured to lock in place in said weight receptacle when said weight member is in a locked position;

wherein said weight member at least partially resides on each side of said locking rail;

wherein said weight member has a width, and wherein said width of said weight member is greater when said weight member is in an unlocked position than when said weight member is in a locked position.

13. The golf club head of claim 12, wherein said weight member comprises a first portion and a second portion, wherein said first portion is slideably affixed to said second portion such that said first portion slides towards said second portion when said weight member is locked in place.

14. The golf club head of claim 13, wherein said weight member comprises a third portion; and wherein said width of said weight member decreases as said third portion is rotated in a first direction.

15. The golf club head of claim 14, wherein rotation of said third portion in a first direction forces said first portion and said second portion to squeeze said locking rail.

16. The golf club head of claim 14, wherein said third portion comprises female threads configured to engage said second portion, wherein said third portion comprises a tapered surface configured to engage said first portion, wherein rotation of said third portion in a first direction forces said third portion towards said golf club head and said first portion, said tapered surface forcing said first portion towards said locking rail.

17. The golf club head of claim 12, wherein said weight receptacle is located on said sole.

18. The golf club head of claim 12, wherein said locking rail comprises a locking rail angle, said locking rail angle measured between a rail locking surface and said exterior surface of said body, wherein said locking rail angle is between 85 degrees and 15 degrees.

19. The golf club head of claim 18, wherein said locking rail angle is between 75 degrees and 25 degrees.

20. The golf club head of claim 18, wherein said locking rail angle is 65 degrees and 35 degrees.

* * * * *